US006411215B1

(12) United States Patent
Shnier

(10) Patent No.: US 6,411,215 B1
(45) Date of Patent: Jun. 25, 2002

(54) OPTICAL METHODS FOR DETECTING THE POSITION OR STATE OF AN OBJECT

(76) Inventor: J. Mitchell Shnier, 25 Lower Links Road, Toronto, ON (CA), M2P 1H5

( * ) Notice: Subject to any disclaimer, the term of this patent is extended or adjusted under 35 U.S.C. 154(b) by 0 days.

(21) Appl. No.: 09/501,488

(22) Filed: Feb. 10, 2000

Related U.S. Application Data

(60) Provisional application No. 60/120,969, filed on Feb. 19, 1999.

(51) Int. Cl.[7] ..... G08B 21/00

(52) U.S. Cl. ..... 340/686.1; 340/686.6; 340/545.3; 340/568.8; 340/568.1; 340/600; 250/221

(58) Field of Search ..... 340/686.1, 545.3, 340/568.8, 568.1, 686.6, 467, 600, 573.1, 572.1; 702/153; 250/221; 382/100; 116/201

(56) References Cited

U.S. PATENT DOCUMENTS

| | | | | | |
|---|---|---|---|---|---|
| 3,446,981 | A | * | 5/1969 | Ackerman et al. | 250/231.11 |
| 3,544,988 | A | * | 12/1970 | Astheimer | 340/600 |
| 3,573,773 | A | * | 4/1971 | O'Hanlon | 340/870.27 |
| 3,643,249 | A | | 2/1972 | Haywood | 340/542 |
| 3,710,052 | A | | 1/1973 | Jette | 200/61.68 |
| 3,852,728 | A | | 12/1974 | Flagg, Jr. | 340/655 |
| 3,886,549 | A | | 5/1975 | Cheal et al. | 342/28 |
| 3,889,118 | A | | 6/1975 | Walker | 250/341.1 |
| 4,026,654 | A | * | 5/1977 | Beaurain | 356/5.07 |
| 4,027,303 | A | | 5/1977 | Nevwirth et al. | 340/552 |
| 4,063,044 | A | | 12/1977 | Stephan | 379/119 |
| 4,092,636 | A | * | 5/1978 | Shepherd, Jr. | 340/545.3 |
| 4,107,661 | A | * | 8/1978 | Crosby | 340/688 |
| 4,239,961 | A | * | 12/1980 | Lasar | 250/221 |
| 4,319,332 | A | | 3/1982 | Mehnert | 342/27 |
| 4,334,145 | A | | 6/1982 | Norris, Sr. | 219/445.1 |
| 4,394,584 | A | | 7/1983 | Spahui et al. | 307/117 |
| 4,446,455 | A | | 5/1984 | Nashawaty | 340/568.1 |
| 4,453,390 | A | | 6/1984 | Moritz et al. | 70/434 |
| 4,507,654 | A | | 3/1985 | Stolarczyk et al. | 340/545.3 |
| 4,559,796 | A | | 12/1985 | De Forrest, Sr. | 70/432 |
| 4,577,181 | A | | 3/1986 | Lipsoher et al. | 340/522 |
| 4,590,410 | A | | 5/1986 | Jönsson | 318/480 |
| 4,659,922 | A | | 4/1987 | Duncan | 250/221 |
| 4,680,704 | A | * | 7/1987 | Konicek et al. | 382/100 |
| 4,683,741 | A | | 8/1987 | Fields | 70/432 |
| 4,706,073 | A | * | 11/1987 | Vila Masot | 340/639 |
| 4,717,909 | A | | 1/1988 | Davis | 340/686.4 |
| 4,760,380 | A | | 7/1988 | Quenneville et al. | 340/542 |
| 4,825,801 | A | * | 5/1989 | Weber | 116/201 |
| 4,843,372 | A | * | 6/1989 | Savino | 340/540 |
| 4,893,005 | A | * | 1/1990 | Stiebel | 250/221 |
| 4,912,456 | A | | 3/1990 | Mickel | 340/542 |
| 5,013,154 | A | * | 5/1991 | Kominsky | 356/615 |
| 5,023,597 | A | * | 6/1991 | Salisbury | 340/573.4 |
| 5,062,670 | A | | 11/1991 | Grossman | 292/137 |
| 5,095,300 | A | * | 3/1992 | Alexander et al. | 340/686.5 |
| 5,111,007 | A | | 5/1992 | Miller et al. | 200/43.08 |

(List continued on next page.)

*Primary Examiner*—Benjamin C. Lee

(57) ABSTRACT

Methods for remotely detecting whether a specific object is in a specific position or state. For example, to detect a desired condition, such as; that a residential sliding door is both fully closed and also locked, or a stove element is turned off, or that a window's pane of glass is intact. Optical methods are used, and in one embodiment a retroreflective surface is affixed to the door's locking handle, or the control dial for the stove element, or the glass surface, respectively, for this example. A narrow light beam illuminates the location where the retroreflective surface would be if; the door is closed and its lock handle is in the locked position, the control dial for the stove element is in the off position, or the window's glass is intact. If a monitoring device senses the retroreflected beam of light, then the retroreflective surface must be in the desired position, and the desired condition has been confirmed. In an embodiment of another method, the monitoring device remotely detects whether an object is in a powered on or off state by using an optical assembly to receive light from the object's power on indicator light.

24 Claims, 4 Drawing Sheets

U.S. PATENT DOCUMENTS 5,214,293 A * 5/1993 NacNiel ..... 250/561
5,248,024 A * 9/1993 Yokosuka ..... 198/341.02
5,250,801 A 10/1993 Grozinger et al. ..... 250/223 B
5,257,841 A 11/1993 Geringer et al. ..... 292/340
5,353,013 A * 10/1994 Estrada ..... 340/575
5,416,316 A 5/1995 Kappeler ..... 250/221
5,475,367 A 12/1995 Prevost ..... 340/568.8
5,543,780 A * 8/1996 McAuley et al. ..... 340/572.1
5,608,378 A 3/1997 McLean et al. ..... 340/568.1
5,646,596 A * 7/1997 Gumm ..... 340/573.1
5,650,764 A * 7/1997 McCullough ..... 340/431
5,657,003 A * 8/1997 Fuentes ..... 340/690
5,689,236 A * 11/1997 Kister ..... 340/545
5,729,194 A * 3/1998 Spears et al. ..... 340/431
5,812,058 A 9/1998 Sugimoto et al. ..... 340/556
5,825,288 A 10/1998 Wojdan ..... 340/542
5,852,292 A 12/1998 Blümcke et al. ..... 250/221
5,854,520 A 12/1998 Buck et al. ..... 307/141
5,930,741 A * 7/1999 Kramer ..... 702/153
6,002,329 A * 12/1999 Marks ..... 340/467
6,157,311 A * 12/2000 Berkovich ..... 340/688

* cited by examiner

OPTICAL METHODS FOR DETECTING THE POSITION OR STATE OF AN OBJECT

CROSS-REFERENCE TO RELATED APPLICATIONS

This application claims priority from provisional application No. 60/120,969, filed Feb. 19, 1999.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to methods for detecting the position or state of an object, and more particularly, using optical means to confirm that a specific object is in a specific desired location, orientation, or state.

It is often required to confirm, from some distance, for example, that a mechanical or other device is in a specific position or configuration, or that an electrical device is powered on or off, that a residential sliding or hinged door is closed and also locked, or that a stove element is not left on for an extended time after use. Prior art has proposed a variety of solutions.

For example, U.S. Pat. Nos. 3,643,249 to Haywood, 4,453,390 to Moritz et al., 4,559,796 to De Forrest, Sr., 4,683,741 to Fields, 4,760,380 to Quenneville et al., 4,912,456 to Mickel, 5,062,670 to Grossman, and 5,111,007 to Miller et al. each disclose an apparatus or system to monitor and indicate whether a door lock set is in the locked position. However, these all require that a specially designed door lock set or mechanism be used, or that special modifications be made to the lock set mechanism or door. Also, as the monitoring method is electrical in nature and is mounted in the door, remote monitoring from the moving or swinging door is difficult as cabling to a moving device always presents several problems (such as how to route the cable, and fatigue of the flexing cable). And local monitoring (that is, a stand-alone unit with no external cabling) requires battery operation, which presents other problems (such as the requirement to change the battery periodically, and the difficulty or expense of remotely monitoring the door locked status, for example by using radio frequency transmission). U.S. Pat. Nos. 4,394,584 to Spahui et al. and 4,507,654 to Stolarczyk et al. can show that a door or window is closed but not whether it is locked. Also, they require the installation of cabling to the door or frame, or a battery-operated device to be located at the door or window, and again, this creates a maintenance and remote monitoring problem. U.S. Pat. Nos. 3,710,052 to Jette, 4,717,909 to Davis, 5,257,841 to Geringer et al., and 5,825,288 to Wojdan, are special assemblies that must be mounted in a door frame to monitor the position of the lock bolt, and as such require a difficult installation procedure of the assembly into the door frame, as well as of cabling to the assembly in the door frame. Also, the assemblies must be compatible with the type of lock and bolt installed, and also require careful mechanical alignment. Finally, these are electromechanical devices, and as such have electrical contacts that can wear out or corrode, have moving mechanical parts that can break or require realignment, and as these devices are accessible from the door frame's mortise, they are vulnerable to damage and vandalism.

And in any case, the above solutions are all specific to doors and windows, and not to the myriad of other monitoring applications, such as stove control dials and sliding doors.

There are many systems described in the prior art for detecting changes in volumes of space. For example, U.S. Pat. Nos. 3,886,549 to Cheal et al., 4,027,303 to Neuwirth et al., and 4,319,332 to Mehnert are intended as security systems to detect new or missing items on a surface, or in a region space. However, these are not well suited to detecting the following; changes in position or orientation of a smaller specific object in that space—especially in the presence of larger objects, or small changes in position of those larger objects in the monitored region, or very slow changes. Also, these are complex systems with microwave radio frequency operation, significant processing requirements to characterize, store, and compare the state of successive scans of the region, and/or other characteristics which result in high construction costs.

Other prior art discloses methods to count or detect objects passing through an area, for example to count items on a conveyor belt or stop a machine if an obstruction is detected in a particular zone. Examples include U.S. Pat. Nos. 3,889,118 to Walker, 4,590,410 to Jonsson, 4,659,922 to Duncan, 5,250,801 to Grozinger et al., 5,416,316 to Kappeler, 5,812,058 to Sugimoto et al., and 5,852,292 to Blümcke et al. However, these have one or more of the following shortcomings; not directional to a specific location, cannot detect the movement or rotation of a specific part of a larger object, or are too limited in the distance to the sensed object.

U.S. Pat. No. 5,475,367 to Prevost discloses a system for detecting the continued presence of valuable items. However, this requires a detector unit to be mounted close to the monitored object, and in any case, is not well suited to detecting small changes in position or rotation of a part of a larger object.

U.S. Pat. No. 5,854,520 to Buck et al. discloses a timer to control the duration that power is applied to the burners of a stove. However, this system requires either substantial modification to an existing stove's controls and electrical system, or that the stove be initially manufactured with the required relays and circuitry. Other inventions also require special wiring to a stove or oven, and mechanical switches to be retrofitted or incorporated into the stove controls and/or other assemblies. For example, U.S. Pat. No. 3,852,728 to Flagg, Jr. discloses an alarm that provides a continuous indication when a stove element is on, and an intermittent indication for a period afterwards, while the stove element cools. This has the problems that users would become so accustomed to the alarm that it would provide little alerting value, there is no provision for remote monitoring, and high-temperature wiring and switches must be installed in the stove. U.S. Pat. Nos. 4,334,145 to Norris, Sr., 4,446,455 to Nashawaty, and 4,577,181 to Lipscher et al. disclose an alarm which detects when a stove element is powered on but there is no utensil placed onto the corresponding stove element. This requires mechanical modifications to be made to the stove to accommodate a specially designed switch, a switch to be attached to each burner assembly, the switch and wiring to be suitable for high-temperature operation, and the switch and assembly to be kept clean so movement is not impeded. Additionally, it does not alarm if the stove element is left on with a utensil on the burner, and does not allow for remote monitoring of the switch status. U.S. Pat. No. 5,608,378 to McLean et al. discloses a system to alert a user if a stove element is turned on and then a dwelling exit door is opened—for example to leave the dwelling. This has the problems that electrical wiring is required to the stove control or indicator light and also to the exit door, that the alarm will sound if the door is opened for another purpose (for example when another member of the family arrives home for dinner), and that the system is of no value if the home-owners leave through an alternate door, or leave the stove on all night while they sleep.

And in any case, the above solutions are all specific to stoves, and not to the myriad of other monitoring applications.

U.S. Pat. No. 4,063,044 to Stephan discloses a system utilizing photocells to monitor the line-busy lights on a telephone. However, the photocells must be placed directly over the lights, the invention is described for use with multi-line telephones only, and alarming is described only when all lights are illuminated (rather than when any one is illuminated, which is more meaningful for security purposes).

Clearly, there is a need for a method of remotely sensing, for example, whether a door is locked, or whether a stove is turned off, without the limitations, installation difficulties and other undesirable features of the prior art.

BRIEF SUMMARY OF THE INVENTION

It is an object of the present invention to provide a method to detect that a specific object is in a specific location, orientation, or state. For example, through monitoring existing surfaces of existing devices, to detect whether a door or window is not only closed but also locked, or whether a fixed appliance with a movable or rotatable control dial, such as a stove, is turned off. Or that a piece of equipment is in a certain location, or that a pane of glass is intact, or that a safe's door is fully closed and the handle in the locked position, or that a machine is or control lever is in a certain position. And such monitoring be accomplished by detecting small changes in the position or orientation of objects such as a door locking lever or stove control dial. Or, through monitoring the existing indicator lights of existing devices, to detect whether the device is powered on or not.

It is a further object of the present invention that no, or little, modification or installation effort be required for the objects or devices to be monitored, so that a wide variety of existing or newly designed items, devices and appliances, such as doors, windows, drawers and stoves can be monitored—and without requiring special assemblies or mechanisms to be designed for, or installed in, or attached to the items, devices or appliances.

It is a further object of the present invention that the monitoring of the items, devices and appliances can be done from a distance, without requiring cabling to be run right to them—since installing cabling is often problematic; as it requires tools and skills, and hiding cabling is difficult, time-consuming and damages walls. And opening items, devices and appliances in order to retrofit switches, and running cabling to them can be dangerous due to the hazardous voltages present in them, and also can void manufacturer warranties. Finally, the present invention also allows some flexibility in the remote mounting location of the monitoring device, both so that it can be unobtrusive, and also to facilitate the installation of any cabling to the monitoring device required.

It is a final object of the present invention that the remote monitoring of the items, devices and appliances be done without the use of radio frequency transmission from the items, devices and appliances, as some people are concerned that there may be health implications to spending substantial amounts of time near radio frequency transmitters. Also, radio frequency transmissions both are subject to interference from other devices, and can cause interference to other devices. Finally, radio frequency transmitters require power supplies, and if these must utilize batteries in order to avoid the use of cabling, then there is the on-going cost of periodically replacing the batteries, as well as the environmental cost of disposing of the used batteries.

In the descriptions herein, the term "handle" shall equally refer to any mechanical lever or slider, electrical switch handle, control knob or dial, or any other movable part, which may or may not be part of another item, device or appliance, whose position is to be monitored.

Also, the terms "movement" or "position" shall equally refer to the rotation, orientation, angle, translation or other possible degrees of freedom of such handles.

And, the term "desired position" refers to a position of the object which is to be confirmed, for example, that a door is fully closed and also locked, or a stove control dial is in the off position. Alternatively, for objects that have a limited number of possible positions, it could be confirmed that an object is in a desired position by determining the converse—that is, that the object is not in any of the undesired positions. Also, an object could also have more than one desired position.

Finally, the term "indicator light" refers to any source of electromagnetic energy, whose intensity or other characteristic is to be monitored in order to detect the state of an item, device or appliance. Typical examples would be a power on or other mode of operation indicator light on an appliance or piece of electronic equipment.

In a first embodiment of the present invention, a small retroreflective surface is affixed to the handle of the item, device or appliance to be monitored. For example, a 5 mm diameter, self-adhesive dot of 3M Company's Scotchlite is applied to the lock handle on a residential exterior sliding door. A monitoring device is then aimed so that it projects a narrow beam of light at the position where the retroreflective surface on the handle would be when the door is fully closed and locked (that is, in the desired position). Then, whenever the handle is in the desired position, the monitoring device will receive the retroreflected light. And when the handle is not in the desired position (for example, the door is closed but not locked, or the door is open but the handle is in the "locked" position), the monitoring device will not receive any retroreflected light. Thus, when the monitoring device receives retroreflected light there is assurance that the door is both fully closed and locked. To report the detected status, an electronic circuit in the monitoring device implements some combination of: a visual and/or audible indication or alert, relay contact output, delay timer, radio frequency or other transmitter, data interface or other means to convey the door status to nearby people, or to a burglar alarm system, network, or other device.

In a second embodiment of the present invention, the retroreflective surface is affixed to a surface to which the light beam from the monitoring device (which has been aimed at the retroreflective surface) is alternately obstructed or unobstructed, depending on the position of the handle being monitored. For example, when the handle is in the desired position the light beam can and does impinge on the retroreflective surface, and this light is retroreflected back to the monitoring device. And when the handle is not in the desired position, the handle obstructs the light path to the retroreflective surface, so no light is retroreflected back to the monitoring device. An example of when this embodiment would be useful is when there is a problem in affixing the retroreflective surface to the handle itself, perhaps because the handle has an irregular shape or the retroreflective surface would get quickly covered with dirt or worn off if it was attached to the handle. This second embodiment is also useful as the aiming of the light source need not be as accurate as for the first embodiment above, and this is described further below.

In another embodiment of the present invention, the retroreflective surface is attached to the interior surface of the glass of a door or window. This can serve as a glass breakage detector for a burglar alarm system—since the breakage of the glass would cause the location of the retroreflective surface to move substantially, and this would be detected by the monitoring device. Or the retroreflective surface could be attached to the interior surface of a door or the frame of a window, so opening the door or window would cause the location of the retroreflective surface to move substantially, and this would also be detected by the monitoring device. While these two types of security monitoring are traditionally done by ultrasonic glass breakage detectors and magnetic reed switch contacts, there are situations where such traditional means are not suitable. For example, when installing the requisite cabling or sensors to the window or door may not be possible due to; a requirement for a temporary installation or not damaging walls (for example, in a rented facility or a historic building), building construction in which it is difficult to run cabling, an architectural or aesthetic requirement to conceal security systems, a hazardous environment where the use of electrical cabling is restricted, the need for a simpler installation procedure (for example, so a consumer can do it themselves), or some other special situation.

In another embodiment of the present invention, the optical assembly of a monitoring device is focussed so that it gathers light directly from the item, device or appliance to be monitored. For example, from the power on indicator light of an appliance. The power on status of the appliance can then be detected without requiring a special switch to be installed in, or cabling to be installed directly to, the appliance. Additionally, this method avoids potential safety issues concerned with potential contact with dangerous voltages in an appliance. In order to reduce the effect of ambient light, a light-absorbing surface may need to be installed around the indicator light, or an optical filter assembly may need to be used in the received light path.

DETAILED DESCRIPTION OF THE INVENTION

It should be noted that the embodiments described herein are for illustrative purposes only, and other embodiments of the present invention will be obvious to those skilled in the art, based on the descriptions herein.

Figure 1A:
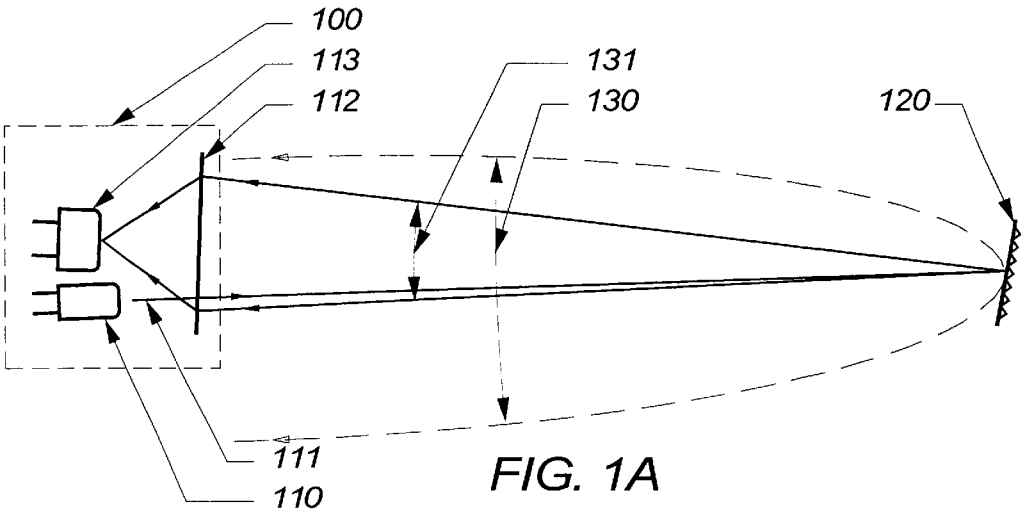
FIG. 1A shows the configuration of a possible embodiment of the present invention, with the incident light retroreflected by an object which is in its desired position.

FIG. 1A shows the main components of a possible embodiment of the present invention, here labelled as monitoring device 100.

In FIG. 1A, light source 110 is aimed to direct its light beam 111 through a hole in plastic Fresnel lens 112, and towards surface 120, which could be a small retroreflective target affixed to the object whose position is to be monitored. Light source 110 could be a solid state laser diode module, such as a Quartron VLM-650-01 LCA, which is a visible (650 nm), 3±1 mW output power laser diode module, with a fixed focus plastic lens and a maximum beam divergence of 0.1° which results in an acceptably narrow light beam diameter of 6±2 mm at a distance of 5 m, and a built-in constant current laser diode driver circuit. Other light sources could be used, such as a laser diode with; an external driver circuit to permit shorter pulse operation to reduce power requirements or increase safety, lower output power or an infrared light output in order to increase safety or to ensure people do not see the beam, higher output power in order to increase the distance over which the monitoring device can operate, and/or variable focus to either increase the spot size and therefore reduce the accuracy of the aiming required or to reduce the spot size to enable detecting smaller changes in the position of the object. Also, an LED (light emitting diode), incandescent, or other type of light source could be used, though external optic elements would then be required to provide a suitably small spot size or light beam intensity at the retroreflective surface. The use of such light sources and optics are well known in the art.

Note that since surface 120 is retroreflective, it does not need to be perpendicular to the light beam 111, and this is shown in FIG. 1A. The surface 120 could be a 5 mm diameter circle of adhesive-backed retroreflective tape, such as 3M Company's Scotchlite or Reflexite Corporation's Microprism Conspicuity Material. Light source 110 is aimed, and retroreflective surface 120 is affixed to the object to be monitored, so that when the object (such as a handle) and whatever it may be part of (such as a sliding door), are moved to their various possible positions, only when the combination of the handle and door are in the desired position (such as both fully closed and also locked) is the retroreflective surface 120 in the path of the light beam 111.

Light source 110 is powered by a power supply, not shown in the figure. In addition to powering light source 110 so that its light output is substantially constant, such power supply could drive light source 110 so that its light output is modulated or pulsed in an analog or digital fashion: for example, on for 1 ms (one millisecond), and then off for 1 s (one second), as this would both reduce the power supply requirements and would also reduce the average light power output in order to address safety concerns such as that of a person looking directly into, or at a specular reflection of, light source 110. Also, through suitable circuitry, modulating the light source output enables the effect of ambient and other interfering light and other sources of noise to be reduced. Such circuits and techniques are well known to those familiar with solid state laser diodes and synchronous demodulation.

Figure 3:
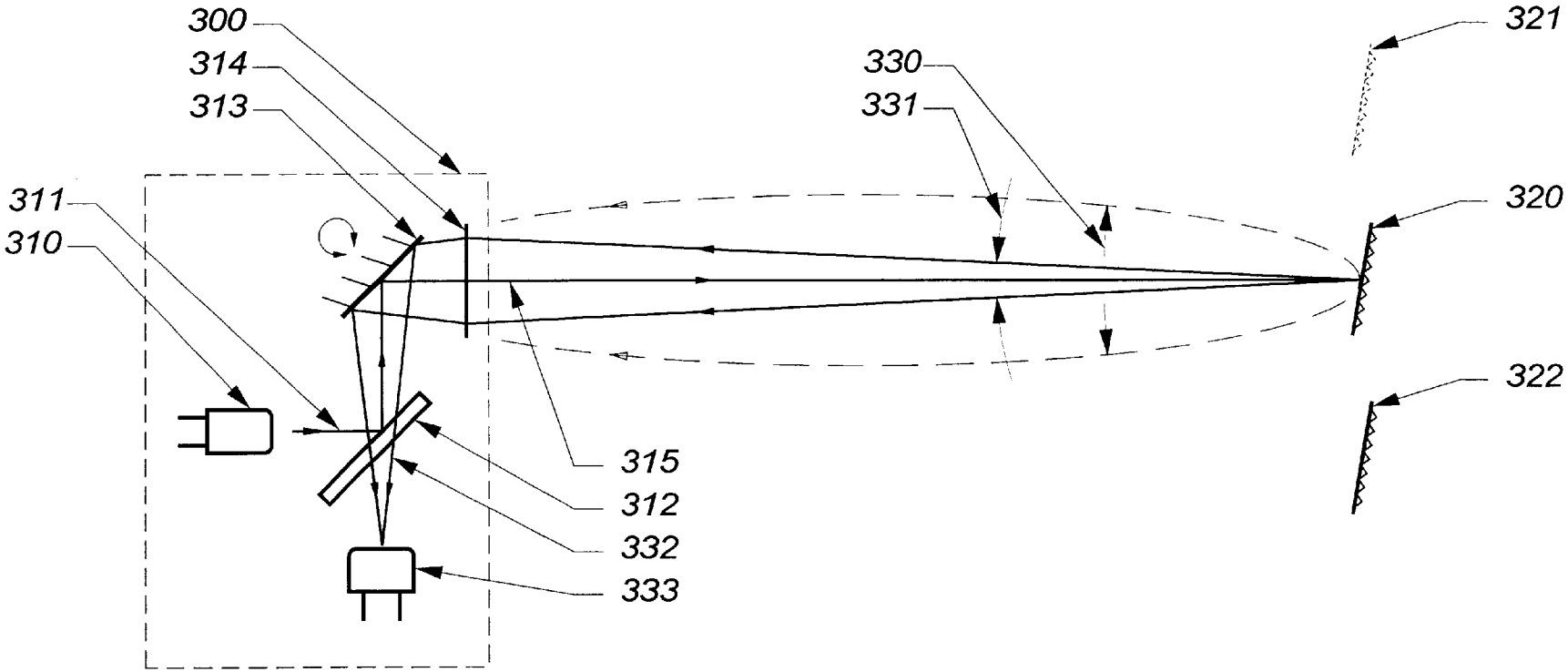
FIG. 3 shows another possible embodiment of the present invention, in this case, where a rotatably mounted mirror is used to aim the light beam at the desired position of a retroreflective surface.

Retroreflective surface 120 reflects light beam 111 back towards light source 110, with some amount of beam divergence and therefore reduction in intensity with distance, as represented by the dashed line 130 which shows points of equal retroreflected light intensity. The exact shape of curve 130 depends on factors such as the directionality of retroreflective material 120 used and the retroreflected light intensity expected. Some amount 131 of the retroreflected light 130 will be received by Fresnel lens 112 and focussed at photodetector 113. Fresnel lens 112 and photodetector 113 are positioned to receive light substantially from the same point as light beam 111 is directed (that is, retroreflective surface 120 in this case). Note that other configurations are possible, such as; using a conventional double convex glass lens or other more complex optical assembly in place of Fresnel lens 112, using a Fresnel lens with an off-center axis to facilitate Fresnel lens 112 gathering light in the center of the retroreflected light 130, using a beam splitter so that the incident light beam 111 and the retroreflected light can share the same axis (an example of this is shown in FIG. 3), and other configurations which are well known to those skilled in the art, and are equally considered embodiments of the present invention.

Photodetector 113 is a phototransistor or other detector sensitive to the wavelengths of light emitted by light source 110, possibly with an optical filter to reduce the reception of wavelengths of light other than those emitted by light source 110. Such photodetectors are widely available.

Photodetector 113 is connected to an electrical circuit, not shown in the figure, which amplifies, filters and otherwise processes the signal from photodetector 113, so that an output is available whose state depends on whether or not photodetector 113 is receiving light from light source 110. Such circuits are well known to those skilled in the art, and would provide an output such as one or a combination of the following:

- an audible alarm, which could sound as soon as photodetector 113 does not receive any retroreflected light;
- an audible alarm, which would sound only if photodetector 113 does not receive any retroreflected light for a settable period of time (either always, or initiated through pushing a button, a time-of-day controller or other method), so that for example; a person could be blocking the path of the light from or to the monitoring device 100 for a minute before the alarm would sound; or a door could be left unlocked or a stove element on for 30 minutes before the alarm would sound;
- an electrically isolated relay contact closure output for connection to an external system such as a burglar alarm system; the burglar alarm system could then include the feature that it could be armed, either at night, or before everybody leaves the residence, only when all doors are confirmed locked (in addition to the traditional confirmation that the doors are closed), and/or all stove elements are turned off (in addition to the traditional confirmation that the smoke detectors are not in an alarm condition);
- a radio-frequency transmitter, for wireless communication with an external system such as a burglar alarm system, as described above; or
- another data transmission system, such as power-line carrier, infrared light, a data bus type connection, Internet connection or other method for connection to an external system, as described above.

Figure 1B:
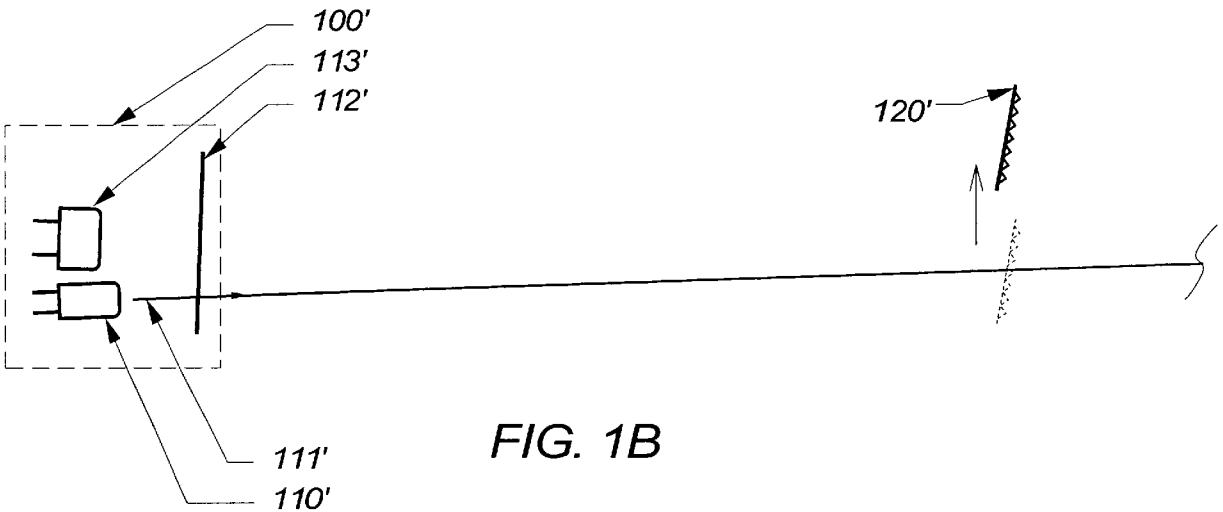
FIG. 1B shows the configuration of a possible embodiment of the present invention, with the incident light not retroreflected, as the object is not in its desired position.

FIG. 1B shows that retroreflective surface 120' has been moved, in this case upwards perhaps because the door lock lever, not shown in the figure, to which it is affixed, is now in the unlocked position. The light beam 111', which was generated by light source 110', and then passes through a hole in Fresnel lens 112' is therefore not reflected back towards photodetector 113', since it does not impinge on retroreflective surface 120'. Therefore, the electrical circuit connected to photodetector 113', and not shown in the figure, can produce the appropriate output signal to indicate this condition.

Note that in FIG. 1A, the minimum distance transverse to incident light beam 111 that retroreflective surface 120 can be moved and for this movement to be detected as a loss of light impinging on photodetector 113 is dependent mainly on the width of incident light beam 111 and the size of retroreflective surface 120 (so long as retroreflective surface 120 is at least somewhat perpendicular to the path of light beam 111). For example, if incident light beam 111 and retroreflective surface 120 both have a diameter of 5 mm and they are substantially aligned, then a transverse (to the path of the light beam) movement of retroreflective surface 120, of 5 mm or any amount greater than this (and even somewhat less than 5 mm, depending mainly on the intensity of incident light beam 111) will be detected at photodetector 113 as a loss of received retroreflected light. If one of the diameter of the incident light beam 111, or the diameter of the retroreflective surface 120, is greater than 5 mm, then only correspondingly larger transverse movements of retroreflective surface 120 will be detected. Ignoring small relative movements of incident light beam 111 and retroreflective surface 120 is useful, for example, when there could be some unintended misalignment of the light beam 111 with the retroreflective surface 120—for example, to allow for; a door which permits some movement even when it is closed and properly locked, shifting of the monitoring device's alignment after installation, vibration, or a greater tolerance of the aiming accuracy required at installation time. However, too great a difference in the diameters could prevent significant movements from the desired position from being detected, so the appropriate sizes need to be worked out as part of the planning or adjustments for an installation.

Alternatively, the diameters of the incident light beam 111 and of the retroreflective surface 120 could both be smaller to enable detecting smaller changes in position of the object, when such is desired.

Since incident light beam 111 and retroreflected light beam 131 are somewhat coaxial, smaller changes in the distance from monitoring device 100 to retroreflective surface 120 may not result in substantial changes in the received light intensity at photodetector 113. When such axial or longitudinal movement of the object is to be monitored, one or more monitoring devices which are at an angle to the expected movement of the retroreflective surface could be used.

Figure 2A:
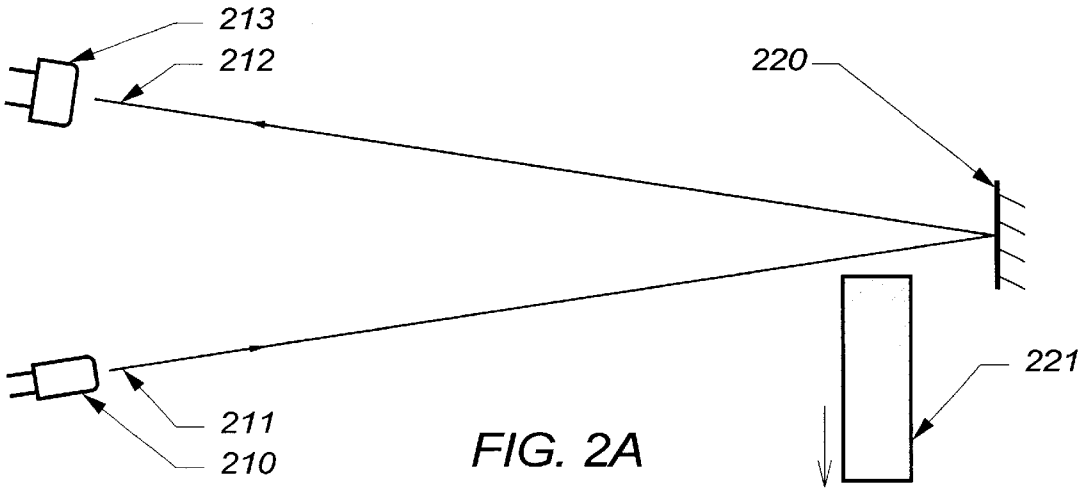
FIG. 2A shows another possible embodiment of the present invention, in this case, where a simple reflecting surface is used in place of the above retroreflecting surface. The object is shown to be in its desired position, as it is not obstructing the incident or reflected light beams.

FIG. 2A shows an embodiment of the present invention where rather than utilizing a retroreflective surface, instead a simple reflecting surface 220 is used, such as metallized Mylar or a glass mirror. Also, in FIG. 2A, rather than the reflective surface 220 being movable relative to the beam of light as in FIGS. 1A and 1B, in FIG. 2A reflective surface 220 is fixed relative to the beam of light, but the incident light beam 211 can be obstructed by a movable and substantially non-reflective object 221 (which in FIG. 2A is not obstructing incident light beam 211).

Since the angle of incidence of the light beam 211 from light source 210 will now equal the angle of reflection, other configurations are now possible. For example, as shown in FIG. 2A the light source 210 need not be co-located with the photodetector 213. This would be useful, for example, so that a single (and wide enough) light source could be used to provide incident light for several such reflective surfaces.

Also, while using a simple reflective, rather than retroreflective surface, has the disadvantage of requiring more careful locating and alignment of light source 210 and photodetector 213 as shown in FIG. 2A, in this configuration the reflected light beam 212 could have (mainly depending on the divergence of incident light beam 211) less divergence than that from a retroreflected surface. Therefore light source 210 and/or the photodetector 213 could be at a greater distance from reflective surface 220, and a Fresnel lens for photodetector 213 may not be required (as is shown in FIG. 2A).

Also, separating the light source 210 and photodetector 213 enables both the transverse as well as longitudinal position of reflective surface 220 to be determined (which is not possible when the incident and retroreflected light beams are substantially coaxial, as in FIG. 1A).

Alternatively, but not shown in the figure, light source 210 could be co-located with photodetector 213, so long as these are perpendicular to the reflective surface 220. In this case, a beam splitter could be used enable both light source 210 and photodetector 213 to share a common axis. A configuration similar to this is shown in FIG. 3, described below.

Figure 2B:
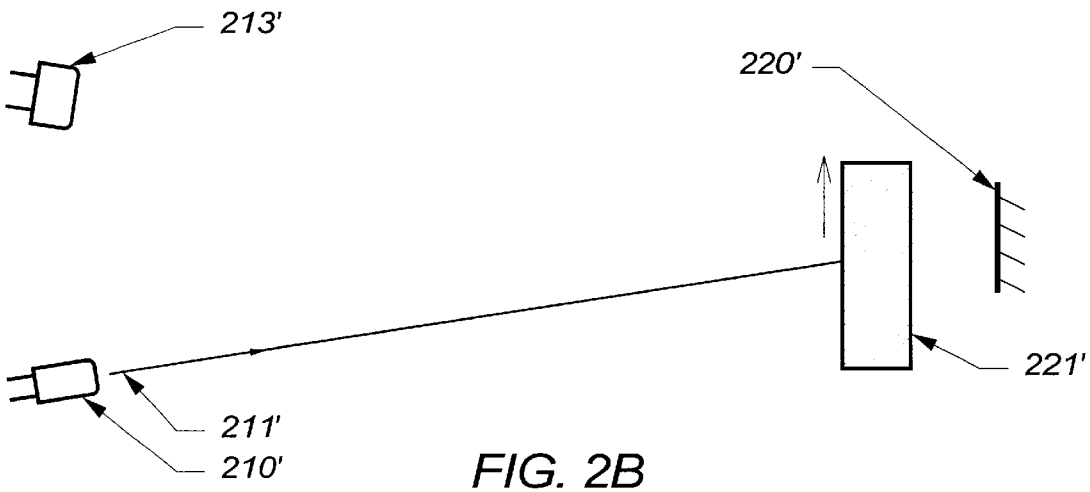
FIG. 2B shows the configuration of FIG. 2A, but with the incident light beam being obstructed, for example, by an object which is not in its desired position.

In FIG. 2B, movable and substantially non-reflective object 221' is obstructing incident light beam 211' from light source 210', so that it does not reach reflective surface 220', thus substantially none of light beam 211' reaches photodetector 213'. Therefore, through appropriate positioning of reflective surface 220, it can be determined whether handle 221 is in its desired position, even when handle 221 has not been modified in any way.

Therefore, using the present invention, a position of an object can be determined both by affixing a reflective surface to it (as in FIGS. 1A and 1B, in which the object moves into or out of the path of the light beam), or a position of an object can be determined by affixing the reflective surface so the object obstructs the light beam from reaching the reflective surface (as in FIGS. 2A and 2B).

Note that in the configuration of FIGS. 2A and 2B, the minimum amount of transverse (to the path of light beam 211) movement of object 221 that can be detected is mainly dependent on the size of reflective surface 220 relative to the size of object 221—and unlike the configuration of FIGS. 1A and 1B, not on the diameter of incident light beam 211. This configuration therefore has the benefit that incident light beam 211 can have any diameter, so long as the beam has enough intensity and convergence so the reflected light beam 212 can be detected by photodetector 213. Therefore, the aiming of the incident light beam 211 at the reflective surface 220 need not be as accurate as required for the configuration in FIGS. 1A and 1B, and yet small movements of the object 221 can still be detected. In the configuration of FIGS. 2A and 2B, the minimum movement of object 221 that can be detected is approximately that equal to the diameter of reflective surface 220. For example, if the diameter of incident light beam 211 at reflective surface 220 is 10 cm, and the diameter of the reflective surface 220 is 5 mm, then approximately a 5 mm movement of object 221 could be detected—and yet the incident light beam 211 could be misaimed by up to (10 cm−5 mm)/2=4.75 cm in any direction.

Note that the above description of locating the reflective surface so that rather than or in addition to the reflective surface moving from the path of the light beam, the light beam can be obstructed by the movement of an object to be detected applies also to the other embodiments described elsewhere herein, such as those using a retroreflective surface, and such configurations are considered embodiments of the present invention.

Also, the embodiments described herein which are using one or the other of a retroreflective or simple reflective target could also utilize the other of a retroreflective or simple reflective target, or also any other surface that can be distinguished by its nature, or as a result of the movement of the object, from the object to which it is attached or which may obstruct it, such one or a combination of the following surfaces:

- paint, pigment, or other coloring;
- fluorescent, or other dye;
- polarizing, perhaps with a retroreflective surface behind it, so that rotation somewhat coaxial to, or with a parallel axis to that of, the path of the incident light beam may be sensed by a change in the retroreflected light intensity or polarization;
- microlouver, such as 3M's microlouver material, perhaps with a retroreflective surface behind it, so that rotation with an axis transverse to the path of the incident light can be sensed by a change in the retroreflected light intensity;
- overlapped Ronchi rulings, perhaps with a retroreflective surface behind them, where two flat Ronchi rulings are used, each with the same pitch and parallel to each other, and with one Ronchi ruling affixed to the object to be monitored and the other is fixed, so that very small (depending on the pitch of the rulings) translational (transverse to both the beam of light and to the direction of the Ronchi rulings) movements of the object can be detected by a change in the retroreflected light intensity;
- the above Ronchi rulings, but with the Ronchi rulings longitudinally on coaxial curved surfaces (one fixed, the other attached to the rotatably movable object), so that small rotations with an axis transverse to the path of the incident light beam can be detected; or
- Ronchi type rulings as tapered radial lines (one fixed, the other attached to the rotatably movable object), for detecting small rotations with an axis parallel to the incident light beam.

Also, note that the present invention can also be used when movable objects are themselves mounted on movable objects—for example, the locking lever on a residential sliding door. In this case, the reflective surface 220 in FIG. 2A could be mounted on the sliding door, behind the locking lever 221, so that the position of the locking lever 221 determines whether light beam 211 is obstructed. But also the entire sliding door is movable, and this moves both locking lever 221 and reflective surface 220 into or out of the path of light beam 211. Affixing reflective surface 220 so that it is unobstructed when the door locking lever is in the locked position, and aiming light beam 211 at the position where the reflective surface would be when the door is closed, enables the monitoring device to confirm that the sliding door is both fully closed, and is also locked. Being able to detect the condition of objects when such multiple degrees of freedom are possible is a particular advantage of the present invention over the prior art.

As above, a power supply circuit not shown in FIGS. 2A and 2B, possibly providing pulsed operation, would provide power for light source 210, as described for FIG. 1A above. And photodetector 213 would be connected to an electronic circuit, also as described for FIG. 1A above.

FIG. 3 shows the use of rotatably mounted mirror 313 to aim incident light beam 315. Also, this embodiment has the feature that the incident light beam 315 shares a common axis with the center axis of the retroreflected light beam 330, and this substantially simplifies the alignment of the monitoring device. Either or both of these two features can equally be applied to the other embodiments described herein, and such combinations are thus considered embodiments of the present invention.

In detail, light source 310 generates light beam 311, and a portion of this reflects off of partially silvered mirror 312 towards mirror 313, and then reflects from it as light beam 315, which passes through a hole in Fresnel lens 314, towards retroreflective surface 320, which is affixed to the object whose position is to be monitored. Mirror 313 is rotatably mounted so it therefore controls the aiming of light beam 315. If the object is then moved so that the retroreflecting surface 320 moves to position 321, for example, then incident light beam 315 would no longer be retroreflected.

As described above, light source 310 could be a visible solid state laser diode module, or other type of visible or invisible (such as infrared) light source. And also as described above, light source 310 is powered by a power supply, not shown in the figure, which could power the light source so that the light output power is pulsed in one of a variety of fashions, for example, in order to reduce the effect of interfering light. Such light sources and power supply circuits are well known to those familiar with the art.

If retroreflecting surface 320 is in the desired position as shown, then incident light beam 315 will be retroreflected back, and curve 330 represents a line of constant light intensity of the retroreflected light. The exact shape of this curve depends on factors such as the directionality of the retroreflective material 320 and the light intensity of interest.

A portion 331 of received retroreflected light 330 is focussed by Fresnel lens 3114, and reflects off mirror 313, and a portion 332 of this light passes through partially silvered mirror 312 and impinges on photodetector 333. As above, an electronic circuit processes the signals from photodetector 333, and provides visual, audible, contact closure or other indication of whether the monitored object is in its desired position.

The hole in Fresnel lens 314 must be large enough to accommodate the width of incident light beam 315. Further, if Fresnel lens 314 does not move with mirror 313 (for example, Fresnel lens 314 is attached to the monitoring device 300's enclosure), then the hole in Fresnel lens 314 must be large enough to accommodate the range of directions in which incident light beam 315 may be aimed. Making the hole too large is undesirable, as that would reduce the received retroreflected light 331 gathered by Fresnel lens 314, and therefore reduce the sensitivity of the monitoring device, therefore necessitating a higher light source 310 output power, more sensitive photodetector 333, more sensitive electronic circuit, or other compensating action.

Note that other configurations of the optics shown in monitoring device 300 could be implemented. For example:

- rather than a hole, Fresnel lens 314 could have an optically flat spot, or depending on the diameter of incident light beam 315, simply projecting light beam 315 accurately through the center of Fresnel lens 314 may result in an acceptably small divergence of incident light beam 315;
- a double convex glass lens or other arrangement of optic elements which provides similar results could be used in place of Fresnel lens 314;
- Fresnel lens 314 could also be used to focus the light 311 from an alternate type of light source 310 which requires focussing, such as an LED or incandescent light;
- Fresnel lens 314 could be located between mirror )13 and partially silvered mirror 312, and this configuration would have the advantage that the hole in Fresnel lens 314 need only be the diameter of the incident light beam 315, regardless of the aim of mirror 313;
- Fresnel lens 314 could be between partially silvered mirror 312 and photodetector 333, this configuration would have the advantage that no hole would be required in Fresnel lens 314;
- if the light beam intensity is adequate, and the beam divergence due to retroreflective surface 320 is small enough (for example, because a reflective, rather than retroreflective surface is used), then Fresnel lens 314 may not be required;
- a prism based beam splitter could be used instead of partially silvered mirror 313; and
- a fiber optic cable could be used to aim the light beam rather than mirror 313.

These and similar methods are well known to those familiar with optics, and incorporation of such variations would be considered alternate embodiments of the present invention.

While rotatably mounted mirror 313 enables incident light beam 315 to be aimed in directions along the plane of the drawing sheet, by utilizing a second rotatably mounted mirror, not shown in the figure, with its axis of rotation in the plane of the drawing sheet and transverse to incident light beam 315, then incident light beam 315 could be aimed in two dimensions. Such more flexible aiming configurations are also considered embodiments of the present invention.

Further, if the rotation of mirror 313, and optionally the second rotatably mounted mirror, is controlled electronically or through some other means, such as through the monitoring device incorporating a microcontroller and a servomotor or piezo-electric positioner, then the installation procedure for the monitoring device would be facilitated as the beam could be aimed automatically. An example installation procedure could then be comprised of the following steps:

- The monitoring device 300 is mounted on a wall, in a location somewhat perpendicular to the movement of the object to be monitored, and provided with power as required.
- A retroreflective surface, of about the size of the beam of light generated by the monitoring device as measured at the object to be monitored, is affixed to the object to be monitored so that the retroreflective surface is somewhat perpendicular to the beam of light generated by the monitoring device.
- The object to be monitored, with the retroreflective surface now affixed to it, is moved to its desired position.
- The monitoring device is initialized so that it scans for the retroreflective surface; when it detects the target, it stores that position as the desired one.
- The monitoring device is now ready for operation, and will output that the monitored object is in its desired position according to whether the monitoring device receives retroreflected light.
- As an optional feature to allow for small changes in the mounted position of the monitoring device 300, for example due to temperature changes and the resulting dimensional changes of monitoring device 300's enclosure or wall attachment, a second retroreflective surface 322 is affixed to a wall or other fixed surface a first distance below the desired position of the first retroreflective surface 320 (which is affixed to the object to be monitored). Then, by using the second retroreflective surface as a reference point, the monitoring device could check for the presence of the first retroreflective surface, which is expected to be the first distance above the reference point. This feature eliminates unintended movements of the monitoring device after installation as a source of alignment errors.

As an alternative to the above optional feature, a second and a third retroreflective surface could be affixed to a wall or other fixed surface a second and third distance to each side of the first retroreflective surface 320's desired position. Then, the monitoring device could determine whether the object to be monitored is in the desired position by scanning to confirm whether the first retroreflective surface is co-linear with the second and third retroreflective surfaces. This method has the significant advantage of not requiring the monitoring device to be calibrated for fixed aiming offsets. Other configurations, such as a single reference retroreflective surface beside the retroreflective surface to be monitored, are also possible. Such other configurations are considered embodiments of the present invention.

Another use for an electronically controlled light beam aiming capability is to utilize a single such monitoring device to monitor a plurality of objects, for example, a two-dimensional matrix of reflective surfaces on a large pane of glass, or several control dials, such as those on a stove. Or if the object to be monitored can be in a plurality of positions or at any position within a continuous range, the monitoring device could track and optionally report on the object's current position or setting as an value within a range, rather than a simple in or out of desired position report.

Advantageous combinations of monitoring a plurality of objects and using reference retroreflective surfaces are also possible. For example, to ensure that a straight line of stove control dials are all in the off position, the reference retroreflective surfaces could delimit the endpoints of the line, and the intervals at which the control dials are located.

Configurations which utilize electronically or otherwise controlled aiming of the monitoring device are considered embodiments of the present invention.

An alternate embodiment not shown in the drawings is to use a single fixed cylindrical lens or mirror to focus the light reflected from all retroreflective surfaces. When the retroreflective surfaces are collinear, the light focussed by the cylindrical lens will also be collinear. Using a broader light source which simultaneously illuminates all retroreflective surfaces allows simultaneously monitoring whether any retroreflective surfaces are not collinear, and also facilitates installation and alignment, since the light source does not need to be as accurately aimed.

There can be advantageous combinations of the present invention with traditional security systems. For example:

The passive infrared (PIR) sensor commonly used as the detector element in a burglar alarm system motion detector could also be used as the photodetector for the present invention. The resulting combined detector would have reductions in the cost, size and installation time compared to utilizing separate detectors. The combined detector could differentiate between the presence of the desired retroreflected signal and a person crossing the path of the motion detector by the characteristics of the received light. For example, if the detected received light had pulse characteristics that matched those of the light source aimed towards the retroreflective surface, then the combined detector could indicate that the object being monitored is in its desired position. The light source's pulses could be at a low enough rate that between pulses the combined detector's PIR sensor could function as part of a traditional PIR-based motion detector.

A wireless (for example, radio frequency) residential window magnetic contact transmitter could also incorporate the present invention to monitor whether the same window, or alternatively perhaps a door across the room from it, is locked. Sharing the radio transmitter between the two functions could again provide cost, size and installation time savings.

Other combinations are possible, and will be obvious to those skilled in these arts, and such are considered to incorporate embodiments of the present invention.

Figure 4:
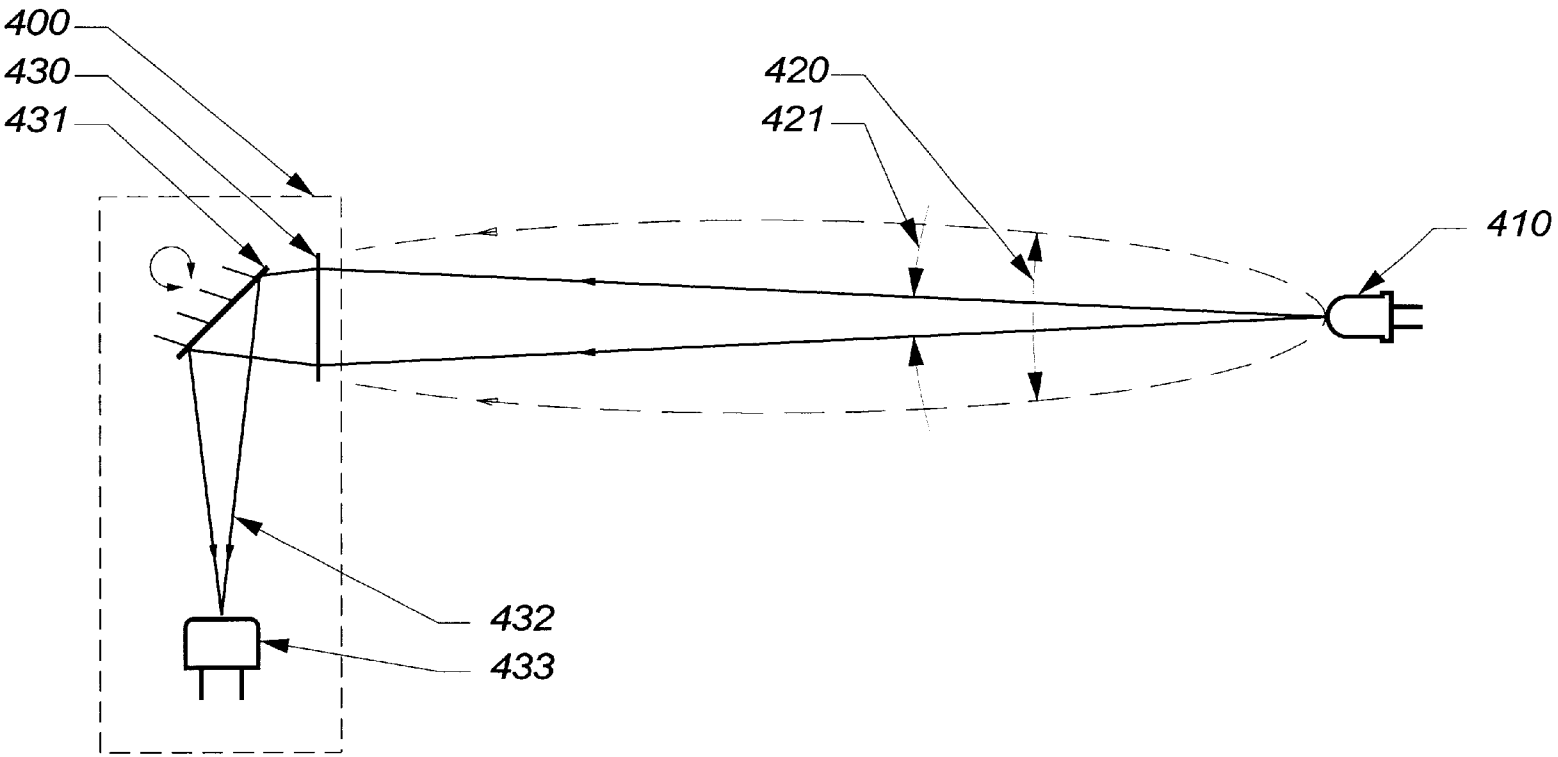
FIG. 4 shows an embodiment of the present invention which detects light generated by a source on the object to be monitored, such as an appliance's power on indicator light.

FIG. 4 shows an embodiment 400 of the present invention which utilizes light 420 generated by the item, device or appliance to be monitored, such as from an indicator light 410 on a stove. A portion 421 of the light is gathered by Fresnel lens 430 and aimed as light beam 432 by rotatably mounted mirror 431 at photodetector 433. As above, a more complex optical assembly may be used to provide more control over the area from which light is gathered. Also, a non-reflective surface could be used around the indicator light 410, and/or an optical filter could be used in the received light path in monitoring device 400 to reduce the interference from ambient and other unintended sources of light. A more or less complex aiming system could be used, for example to either provide automatic two-dimensional aiming, or to require the entire monitoring device 400 to be manually aimed, in order to reduce manufacturing costs. Photodetector 433 would be connected to an electronic circuit, not shown in the figure, to amplify and process the signals and provide an output as required, as described above. Indicator light 410 would typically be an existing part of the item, device or appliance, not shown in the figure, to be monitored, and therefore would be powered by it.

Note that the method of FIG. 4 can be advantageously combined with one or more of the previous methods, such as that shown in FIG. 3. That is, one or more reference retroreflective surface(s) could be illuminated by the monitoring device, and this could be used to assist the monitoring device in locating the expected position of an indicator light, from which the monitoring device then checks for generated light to determine whether or not the object being monitored is in a powered on state.

Therefore, what I claim as my invention is:

1. An optical method of remotely detecting whether a first object is in a specific position, location or orientation, here called the desired position, said method comprising the steps of:

a) utilizing optically retroreflective means associated with said first object;

b) utilizing a light source which produces a beam of light, said beam of light being at least partially collimated, c) directing said beam of light at the location where said retroreflective means would be when said first object is in said desired position;

d) utilizing means to detect the reflected light from said retroreflective means;

e) locating said means to detect said reflected light so that said means to detect said reflected light receives at least a portion of the light reflected from said retroreflective means when said first object is in said desired position;

the intensity of said light source and the collimation of said beam of light therefrom, the amount of light reflected from said retroreflective means and the divergence of said beam of light therefrom, the amount of said light reflected which is gathered by said means to detect said reflected light and the sensitivity thereof all being such that said means to detect said reflected light can be located at least one meter from said retroreflective means and said reflected light can be reliably detected, said light source and said means to detect said reflected light both being mounted in the same sensor enclosure, whereby, according to the light received at said means to detect said reflected light, the state or condition of an appliance, device, machine or other piece of equipment can be remotely detected, without running wiring to, or making mechanical or electrical modifications to the appliance, device, machine or other piece of equipment.

2. The method of claim 1, wherein said retroreflective means is mounted on said first object, whereby motion of said first object results in said retroreflective means moving in to and out of said beam of light, said beam of light having;

substantially the same beam width as height, and a beam width and height which differ from the maximum diameter of said retroreflective means by no more than a factor of five, whereby confirmation that said first object is in said desired position is obtained when said beam of light reflects from said retroreflective means back to said means to detect said reflected light, and confirmation that said first object is not in said desired position is obtained when said beam of light does not illuminate said retroreflective means, and therefore does not reflect from said retroreflective means back to said means to detect said reflected light.

3. The method of claim 2, wherein the cross-sectional shape and area of said beam of light as measured at said retroreflective means, and the shape and area of said retroreflective means, is such that the range of possible movement of said retroreflective means includes moving in to, and out of said beam of light, whereby such range of movement produces a measurable change in the light received at said means to detect said reflected light.

4. The method of claim 1, wherein said retroreflective means is mounted such that the range of possible movement of said first object includes said first object moving in to, and out of the path of said beam of light, thereby obstructing and not obstructing said beam of light's path to said first reflective means, whereby said first object has a cross-sectional shape and area which can block enough of said beam of light such that a measurable change in the light received at said means for detecting said reflected light will occur according to said range of possible movement.

5. The method of claim 4, wherein said first object will not obstruct said beam of light when said first object is in said desired position, and said first object will obstruct said beam of light when said first object is not in said desired position, whereby confirmation that said first object is in said desired position is obtained when said beam of light reflects from said retroreflective means back to said means to detect said reflected light, without being obstructed.

6. The method of claim 4, wherein said first object will obstruct said beam of light when said first object is in said desired position, and said first object will not obstruct said beam of light when said first object is not in said desired position, whereby confirmation that said first object is not in said desired position is obtained when said beam of light reflects from said retroreflective means back to said means to detect said reflected light, without being obstructed.

7. The method of claim 1, wherein said retroreflective means is selected from the group consisting of:

a) a micro-ball based retroreflective material, whereby a high-quality reflection with substantially uniform intensity across said reflection's width is produced, and b) a corner-reflector based retroreflective reflector, and c) polarizing material, with a retroreflective backing, whereby the angle of rotation of said polarizing material will affect the amount of light reflected, and d) a microlouvered surface, with a retroreflective backing, whereby the amount of light reflected will depend on the angle of incidence of said beam of light onto said microlouvered surface, and e) overlapped Ronchi rulings, with a retroreflective backing, whereby the amount of light reflected will depend on the angle of incidence of said beam of light onto said overlapped Ronchi rulings, and f) other material, whereby the amount of reflected light, from said beam of light which is reflected back to said means to detect said reflected light, depends on a characteristic of how said beam impinges on said other material, whereby said means to detect said reflected light can detect whether said first object is in said desired position, according to said reflected light.

8. The method of claim 1, wherein said first object is a movable part of another item, device or appliance, said movable part selected from the group consisting of:

a) a locking lever or knob, and b) a control lever or dial, and c) a handle or knob of an electrical switch, and d) a surface of a pane of glass or door, and e) other a physical element, whereby said movable part's position or presence indicates useful information concerning the state of said item, device or appliance.

9. The method of claim 1, wherein said retroreflective means is mounted directly of said first object, whereby the presence of valuable or important objects can be continuously verified.

10. The method of claim 1, wherein said retroreflective means is mounted on a second object which moves into and out of said light path as a result of movement of said first object, whereby the implementation of said method could be facilitated for some configurations.

11. The method of claim 1, wherein the light source is selected from the group consisting of:

a) a semiconductor laser diode, and b) a light emitting diode, with suitable optical elements to collimate the beam of light to a beam width in the order of a few millimeters so that said first object's movements in the order of a few millimeters can be detected.

12. The method of claim 1, further comprising means for automatically aiming said light source, which in some sequence utilized when first installed, and while said first reflective means is in said desired position and as required thereafter, performs a recalibrating function wherein said light source is aimed at said first reflective means and stays aimed thereat until another said recalibrating function is initiated, whereby installation and subsequent realignment is facilitated, thereby simplifying and automating the installation and any required subsequent re-aiming.

13. The method of claim 1, further comprising:

a) additional reflective means mounted at predetermined locations adjacent to said first reflective means, said predetermined locations being collinear with said first reflective means when said first reflective means is in said desired position, and said predetermined locations being non-collinear with first said retroreflective means when said first reflective means is not in said desired position;

b) means for automatically aiming said light source, which, in some sequence utilized when first installed and periodically thereafter, directs said beam of light to said additional reflective means to recalibrate the location of said desired position, c) means for automatically aiming said light source, which will aim said light source at said desired position when not performing said recalibration;

whereby said first object can be confirmed to be in said desired position when said first reflective means and said additional reflective means are detected to be collinear, and whereby said aiming can be self-aligning as only the relative orientation of said first reflective means to said additional reflective means is critical, rather than requiring the absolute aiming of said light source at said first reflective means.

14. An optical method of remotely detecting whether a first object is in a specific position, location or orientation, here called the desired position, said method comprising the steps of:

a) utilizing first retroreflective means mounted on said first object;

b) mounting additional retroreflective means at predetermined locations adjacent to said first reflective means, said predetermined locations being collinear with said first reflective means when said first reflective means is in said desired position, and said predetermined locations being non-collinear with first said retroreflective means when said first reflective means is not in said desired position;

c) directing a beam of light from a light source, said beam have large enough cross-section and aimed, to simultaneously illuminate said first retroreflective means as well as said additional retroreflective means;

d) utilizing optical elements, said elements including a cylindrical lens or cylindrical mirror, mounted so that the reflected light from both said first retroreflective means and said additional retroreflective means is focussed onto substantially the same first line when said first reflective means is in said desired position;

e) utilizing optical detecting means to detect whether there is a second line displaced from and parallel to said first line; said optical detecting means need only detect line displacement along a single axis parallel to the axis of said cylindrical lens or cylindrical mirror, said light source, said optical elements, and said optical detecting means all being mounted in the same sensor enclosure, and said sensor enclosure being located at least one meter from said first object;

whereby due to said cylindrical lens or cylindrical mirror, said optical detecting means is substantially simplified due to the need to only detect the presence of a line offset along a single axis, and whereby the requirement for accurate aiming of said beam of light is substantially reduced through the use of said cylindrical lens or cylindrical mirror, since light reflected from said first retroreflective means will be spread out to form a line, and whereby the presence of said second line displaced from said first line indicates that said first object is not in said desired position, and whereby the state or condition of an appliance, device, machine or other piece of equipment can be remotely detected, without running wiring to, or making mechanical or electrical modifications to the appliance, device, machine or other piece of equipment.

15. A method of remotely detecting the state of a selected first object, said selected first object requiring electricity to perform its primary function, according to light emitted by a selected indicator light, said indicator light being an integral part of the original design of said selected first object for the purpose of being directly viewed by a user thereof to directly discern said state and electrically connected to the internal electrical circuitry of said selected first object, and said selected indicator light changing a characteristic of said light emitted therefrom according to said state of said selected first object, said method comprising the steps of:

a) utilizing a detector unit which includes means to filter, focus and detect light, said filter having optical bandpass characteristics as required to attenuate the light from interfering sources while providing less attenuation of at least some of the wavelengths of said light emitted by said selected indicator light, b) said detector unit having suitable optical elements to provide focussing and directionality so that said light emitted by said selected indicator light can be detected at a distance of at least one meter from said selected indicator light, c) aiming said detector unit at said selected indicator light so that only said light emitted by said selected indicator light is received by said detector unit, and sources of light from possible other indicator lights and possible other sources of interfering light are not received by said detector unit;

d) detecting a characteristic of the light produced by said selected indicator light, said characteristic selected from the group consisting of;

whether said light is on or off, the color of said light, the intensity of said light, and the blinking rate of said light, whereby, according to said characteristic of the light, the state or condition of an appliance, device, machine or other piece of equipment can be remotely detected, without running wiring to, or making mechanical or electrical modifications to said appliance, device, machine or other piece of equipment.

16. The method of claims 1 or 14, wherein said light source produces light in a manner selected from the group consisting of:

a) on constantly, and b) pulsed, with a predetermined duty cycle, and c) analog modulated, whereby benefits including ease of initial alignment, power savings, increased visual safety, and increased security can be realized.

17. The method of claims 1 or 14, wherein said sensor enclosure incorporates other components used to perform other functions, whereby the sharing of said sensor enclosure provides benefits, such as disguising the implementation of said method, taking advantage of all functions needing to be performed from a similar physical location, and cost and size reduction through shared components.

18. The method of claims 1, 14 or 15, wherein a change in the light received at said means to detect said received light will result in annunciating this, utilizing a method selected from the group consisting of:

a) audible means, and b) visual means, and c) an electrical contact closure or equivalent electronic switching action, and d) data communications method, and e) radio frequency, and f) infrared light transmission, whereby said state or condition of said appliance, device, machine or other piece of equipment can be communicated to people or other systems.

19. The method of claim 18, wherein said annunciation is delayed for a period of time, said period of time being at least as long as an event selected from the group consisting of;

a) the time said appliance, device, machine or other piece of equipment is normally expected to be in that state, and b) the time a person using said appliance, device, machine or other piece of equipment is normally standing at it, and c) the time required for a person to walk past said appliance, device, machine or other piece of equipment, whereby such expected changes in said light received will not be annunciated.

20. The method of claim 19, wherein the duration of said period of time is set by a means selected from the group consisting of:

a) at the time of manufacture, and b) at the time of installation, and c) by a user.

21. The method of claim 18, wherein said annunciation indicates the degree of change of said light received, whereby the corresponding change of said first object's state or condition can be determined.

22. The method of claim 15, wherein a partially collimated light source is located in the enclosure housing said detector unit, aimed substantially where said means to detect light is aimed, said partially collimated light source being powered off during normal mode in which said means to detect light detects light from said selected indicator light, and said partially collimated light source being powered on at some predetermined duty cycle during aiming mode to facilitate aiming said detector unit at said selected indicator light, whereby, said aiming mode facilitates initial installation of said detector unit, and subsequent re-aiming thereof, as the location at which said means to detect light is aimed will be illuminated thereby providing an immediate visual indication of where said means to detect light is aimed, and whereby, said normal mode enables normal operation in which said partially collimated light is powered off and will therefore not interfere with said means to detect light detecting light from said selected indicator light.

23. The method of claim 15, further comprising means for automatically aiming said detector unit, which in some sequence utilized when first installed, and while said selected indicator light is illuminated and as required thereafter, performs a recalibrating function wherein said detector unit is aimed at said selected indicator light and stays aimed thereat until another said recalibrating function is initiated, whereby installation and subsequent realignment is facilitated, thereby simplifying and automating the installation and any required subsequent re-aiming.

24. The method of claim 15, wherein said detector unit is incorporated in a device which performs other functions, whereby the sharing of said device's enclosure provides benefits, such as disguising the implementation of said method, taking advantage of all functions needing to be performed from a similar physical location, and cost and size reduction through shared components.

* * * * *